US005624321A

United States Patent [19]

Snyder

[11] Patent Number: 5,624,321

[45] Date of Patent: Apr. 29, 1997

[54] SPRING-ACTUATED SWING DEVICE

[76] Inventor: Stephen D. Snyder, 17721 SW. 75th Ave., Miami, Fla. 33157

[21] Appl. No.: 372,812

[22] Filed: Dec. 23, 1994

[51] Int. Cl.[6] ..... A63G 9/14

[52] U.S. Cl. ..... 472/118; 472/135; 267/70

[58] Field of Search ..... 472/118, 135; 482/69, 77; 267/70, 69, 71, 131, 174, 33

[56] References Cited

U.S. PATENT DOCUMENTS

| | | | |
|---|---|---|---|
| D. 348,502 | 7/1994 | Webb, Jr. . | |
| 1,194,417 | 8/1916 | Pelham | 267/71 X |
| 1,340,904 | 5/1920 | Medart . | |
| 1,388,241 | 8/1921 | Dierking | 267/70 |
| 1,756,413 | 4/1930 | Wilke et al. . | |
| 2,532,444 | 12/1950 | Germana . | |
| 2,709,079 | 5/1955 | Bubb et al. . | |
| 2,745,621 | 5/1956 | Boisselier . | |
| 3,186,711 | 6/1965 | Morrow . | |
| 3,256,016 | 6/1966 | Berlin . | |
| 3,411,774 | 11/1968 | Thornton . | |
| 4,138,104 | 2/1979 | D'Amicis . | |
| 4,296,923 | 10/1981 | Ahrens . | |
| 4,431,183 | 2/1984 | Reimann . | |
| 4,515,100 | 5/1985 | Grierson | 267/71 X |
| 4,592,697 | 6/1986 | Tuda et al. | 267/71 X |
| 4,681,303 | 7/1987 | Grassano | 267/70 X |
| 5,342,245 | 8/1994 | Webb, Jr. . | |

FOREIGN PATENT DOCUMENTS

| | | | |
|---|---|---|---|
| 1197134 | 11/1959 | France | 267/71 |

OTHER PUBLICATIONS

"Air Pogo", Item #737, *Back to Basics Toys* Holiday '94/Spring '95 catalog, p. 30.

"Air Pogo"™ Advertisement, Hypergee, inc., Hattiesburg, MS 39403, date unknown.

*Primary Examiner*—Kien T. Nguyen

*Attorney, Agent, or Firm*—Lott & Friedland

[57] ABSTRACT

A spring-actuated swing device. The spring-actuated swing device includes a seat having a receiving surface, at least one line, each of the lines having a bottom connecting point removeably attachable to the receiving surface and having a top connecting point removeably attachable to a support beam, and at least one spring mechanism. Each of the spring mechanisms is removably attachable to at least one intermediate connecting point of each of the lines intermediate the receiving surface and the support beam, and each of the spring mechanisms displaces a portion of each of the lines. The spring mechanism includes either a compression, stirrup or extension spring, and may also include an emergency strap. A method for producing swinging and/or bounce in playground, athletic or recreational equipment using the spring mechanism is also provided.

21 Claims, 9 Drawing Sheets

SPRING-ACTUATED SWING DEVICE

TECHNICAL FIELD

This invention relates generally to playground, athletic and recreational equipment and this invention specifically relates to a spring-actuated swing device utilized on various types of playground, athletic and recreational equipment.

BACKGROUND OF THE INVENTION

In the playground, athletic and recreational equipment industries, traditional swing devices comprise a seat, a supporting structure for the seat, and at least one line adjoining the seat to the supporting structure. Users of the swing achieve the swinging effect by pumping their legs, or in the case of smaller children, through a push by supervising adults or older children. The swinging effect is maintained through continued leg pumping or pushing.

Previous attempts have been made to provide springs within playground, and other types of swinging devices, such as are described in U.S. Pat. No. 5,342,245, to Webb, Jr. (the '245 patent); U.S. Pat. No. 4,138,104, to D'Amicis (the '104 patent); U.S. Pat. No. 3,256,016, to Berlin (the '016 patent); U.S. Pat. No. 3,186,711, to Morrow (the '711 patent); U.S. Pat. No. 2,745,621, to Boisselier (the '621 patent); U.S. Pat. No. 1,756,413, to Wilke et al. (the '413 patent); and U.S. Pat. No. 1,340,904, to Medart (the '904 patent), all of which are incorporated herein by reference.

The '245 patent describes a recreational swing which utilizes a heavy gauge extension spring enclosed in and attached to a rigid tube. A swing seat is joined to the tube and locked in place between a collar and reinforced base. The weight of a rider on the swing extends the spring, which gently rebounds, causing a wavelike motion. The bouncing action of the swing may be perpetuated by a rider's movement on the swing.

The '104 patent describes a playground swing mounting system having a conventional horizontal crossbar support modified by the addition of a brake tube fitted around an opening in the lower side of the crossbar and welded thereto. The upper end of the upper portion of the side supports of the seat of the swing is connected by a short flexible chain to a coil spring. At rest, the spring, chain, and top few inches of the upper portion are located within a brake tube. In this position, the movement of the swing is sharply curtailed by the engagement of the portions in their respective brake tubes and it is impossible to cause free swinging movement of more than a few degrees, which would present little danger of injury.

The '016 patent describes a combination baby swing and automobile seat and includes an S-shaped hanger piece secured to the swing frame assembly. The hanger piece supports a link which in turn secures spring means, which comprises an extensible body portion with coil spring mechanism of a construction well-known in the art. The spring means are preferably somewhat inelastic and provide just enough resiliency in order to achieve a smooth oscillating action and eliminate any jerking motions, especially at the end of a movement in one direction and the start of a return movement in the opposite direction.

The '711 patent describes a playground toy and exercising device comprising a cage-like carrier formed by a plurality of rings. The rings are bolted together and secured with a strap. An eye of round, rod-like material comprises portions which are welded to the top of strap. The eye receives the lower end of a suspending strand, which may be a light chain, nylon rope, or any other suitable material. The two lengths of the strand are united by a stout spring. The upper end of the strand is connected by an S hook to a suspension eye. When a youngster exerts physical effort by swinging, twisting back and forth, or bouncing, the youngster actuates the spring and is able to maintain his position within the carrier.

The '413 patent describes a ball bearing swing hinge including a coiled spring. At the upper end of the spring is an eye which can be engaged through a slot in the seat of a shank. At the lower end of the spring is an eye, adapted to be engaged in a ring carrying the cable which suspends the swing. The swing is yieldably supported owing to the presence of the spring.

All of the devices described in the above-discussed references require either the rider, or the person supervising the rider, to periodically apply the same force to the rider or device necessary to initiate the swinging or bouncing motion in order to maintain the swinging and/or bouncing motion. For instance, a disabled rider (or a young child) unable to pump his legs in order to sustain a swinging and/or bouncing motion requires a supervisor to periodically push him or the swing.

Additionally, instructing beginners how to utilize a number of playground, athletic and recreational devices which include lines fixed to a surface, such as, for example, gymnastic rings, may be facilitated by the displacement of portions of the line with spring-actuating mechanisms.

Furthermore, the American Society of Testing Materials (ASTM), in its Standard Consumer Safety Performance Specifications, sets forth particular safety standards for both public and home playground equipment.

Thus, there is a need in the art for a spring-actuated swing device which sustains its swinging and/or bouncing motion for an extended period of time without the repeated need for force in order to maintain such motion.

There is an additional need in the art to provide a spring mechanism which may be retrofitted onto existing playground, athletic and recreational devices in order that such devices can sustain a swinging and/or bouncing motion without repeatedly applying force to the device.

There is an additional need in the art to provide a spring mechanism for producing bounce in athletic equipment in order to facilitate instruction of the use of such equipment.

There is an additional need in the art for a method for producing swinging and/or bounce in playground, athletic and recreational equipment such that the equipment can continue swinging and/or bouncing without repeatedly applying force to the piece of equipment.

There is an additional need in the art for a method for producing swinging and/or bounce in playground, athletic and recreational equipment such that small and/or handicapped users can sustain swinging and/or bouncing motion without the necessity for the repeated application of force to the piece of equipment.

There is an additional need in the art for a spring-actuated swing device which conforms to industry safety standards.

SUMMARY OF THE INVENTION

The present invention solves significant problems in the art by providing a spring-actuated swing device. Generally described, the present invention provides a spring-actuated swing device which includes a seat having a receiving surface, at least one line, each of the lines having a bottom connecting point removeably attachable to the receiving surface and having a top connecting point removeably attachable to a support beam, and at least one spring mechanism. Each of the spring mechanisms is removably attachable to at least one intermediate connecting point of each of the lines intermediate the receiving surface and the support beam, and each of the spring mechanisms displaces a portion of each of the lines.

In preferred embodiments of the invention, the spring mechanism includes a compression or stirrup spring, an elongated member affixed to a lower end of the compression or stirrup spring, and a housing enclosing the compression or stirrup spring and having at least one aperture at a top end through which the elongated member extends. In another preferred embodiment, the spring mechanism includes an extension spring, an elongated member affixed to an upper end of the extension spring, and a housing enclosing the extension spring and having at least one aperture through which the elongated member extends. The spring mechanism can include an emergency strap. With a stirrup spring, the spring can extend through the elongated member, or the elongated member can extend through the spring. Additionally, with a stirrup spring, one of the stirrup members acts as the enlongated member. With a compression or extension spring, the elongated member can be a rigid material, such as steel, or it can be a rope, chain or cable. The housing can be made of plastic, fiberglass, metal or wood.

In another aspect, there is provided a spring mechanism for producing swinging and/or bounce in home and public playground equipment, such as swings and swingsets; trees with sufficiently weight bearing horizontal limbs; and athletic or recreational equipment, such as gymnastic rings and climbing ropes. The spring mechanism includes a compression or stirrup spring, an elongated member affixed to a lower end of the compression or stirrup spring, and a housing enclosing the compression or stirrup spring and having at least one aperture at a top end through which the elongated member extends. The spring mechanism can include an emergency strap. With a stirrup spring, the spring can extend through the elongated member, or the elongated member can extend through the spring. Additionally, with a stirrup spring, one of the stirrup members acts as the enlongated member. With a compression spring, the elongated member can be a rigid material, such as steel, or it can be a rope, chain or cable.

In still another aspect, there is provided a spring mechanism for producing swinging and/or bounce in playground, athletic or recreational equipment, wherein the spring mechanism includes an extension spring, an elongated member affixed to an upper end of the extension spring, and a housing enclosing the extension spring and having at least one aperture through which the elongated member extends. The spring mechanism can include an emergency strap. The elongated member can be a rigid material, or it can be a rope, chain or cable.

In yet another aspect, there is provided a method for producing swinging and/or bounce in playground, athletic or recreational equipment which includes providing a seat including a receiving surface, providing at least one line, each of the lines having a bottom connecting point removeably attachable to the receiving surface and having a top connecting point removeably attachable to a support beam, and providing at least one spring mechanism. Each of the spring mechanisms is removably attachable to at least one intermediate connecting point of each of the lines intermediate the receiving surface and the support beam, and each of the spring mechanisms displaces a portion of each of the lines. One places an object or person in the seat, and applies force to the piece of equipment, such that the the piece of equipment continues to swing and/or bounce for an extended period of time without repeatedly applying force.

Accordingly, it is an object of the present invention to provide a spring-actuated swing device which sustains its swinging and/or bouncing motion for an extended period of time without the repeated need for force in order to maintain such motion.

It is an additional object of the present invention to provide a spring mechanism which may be retrofitted onto existing devices in order that such devices can sustain a swinging and/or bouncing motion without repeatedly applying force to the device.

It is an additional object of the present invention to provide a spring mechanism for producing swinging and/or bounce in playground, athletic or recreational equipment in order to facilitate instruction of the use of such equipment.

Still another object of the present invention is to provide a method for producing swinging and/or bounce in playground, athletic or recreational equipment such that the piece of equipment can continue swinging and/or bouncing without repeatedly applying force to the piece of equipment.

A feature of the invention is to provide an emergency strap in the spring mechanism so that the line or lines will not collapse if the spring should break or otherwise fail.

Another feature of the invention is to provide a housing for the spring mechanism, thereby protecting the spring mechanism from adverse weather elements and enhancing safety so that users can not tamper with or otherwise touch the spring mechanism.

An advantage of the invention is that small or handicapped users can use the invention for an extended period of time without requiring the application of repeated force.

These and other objects, features, and advantages of the present invention may be better understood and appreciated from the following detailed description of the embodiments thereof, selected for purposes of illustration and shown in the accompanying drawings.

DETAILED DESCRIPTION OF THE PREFERRED EMBODIMENT

Figure 1:
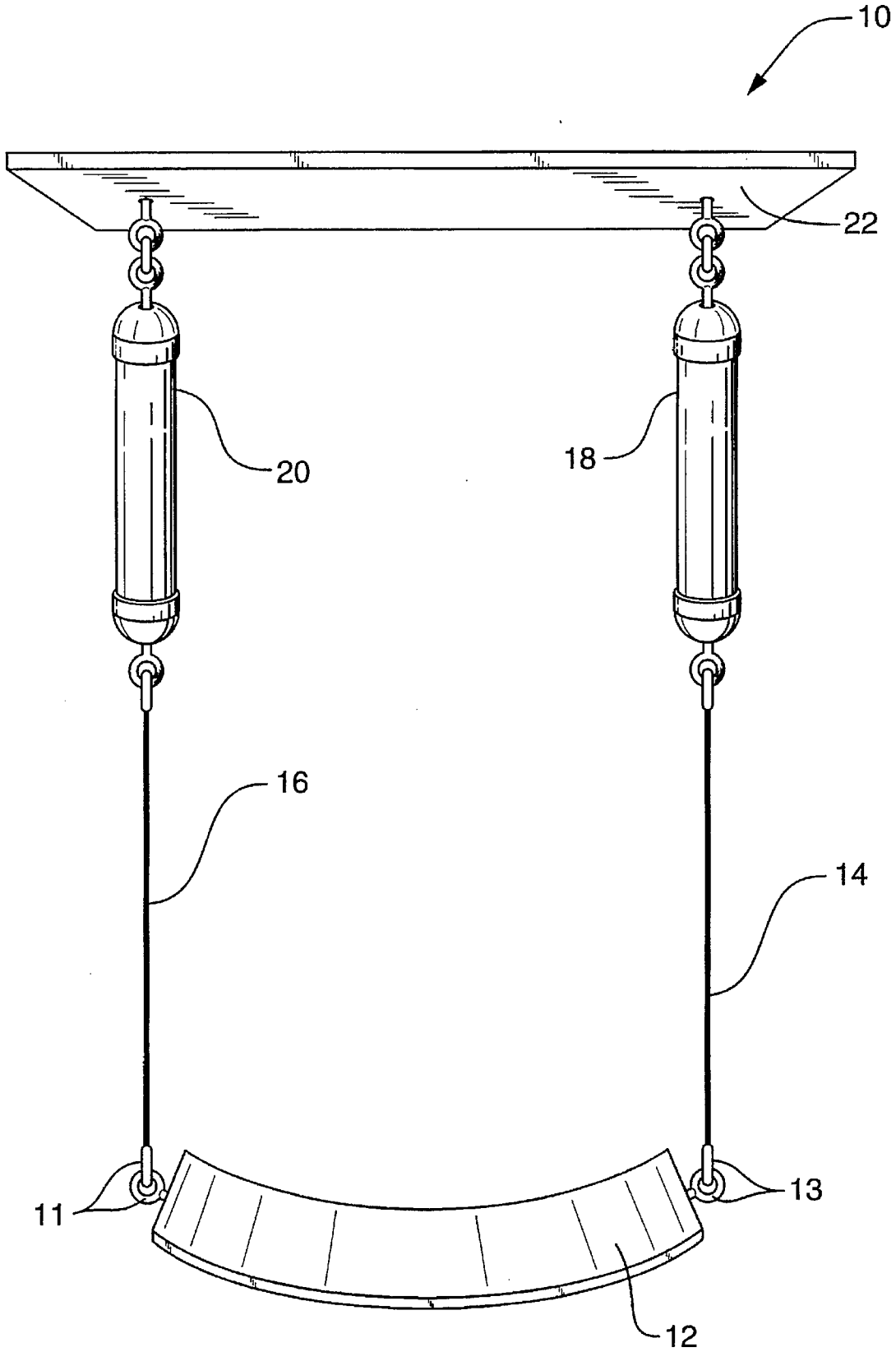
FIG. 1 is a plan view of a preferred embodiment of the spring-actuated swing device according to the invention.

Referring initially to FIG. I of the drawings, in which like numerals indicate like elements throughout the several views, in a preferred embodiment the spring-actuated swing device of this invention is generally illustrated by reference numeral 10. A seat 12 is attached by any one of known attachment methods to lines 14, 16 via attachment structures 11, 13. Seat 12 can be of any one of a number of configurations, i.e. a strap, a rigid flat surface, or a chair-type configuration which includes a back support, among other configurations. There may also be straps and/or buckles to hold the user in such seat 12. For ease of illustration, a strap seat is shown. Spring mechanisms 18, 20 are removeably attached, at their lower ends, to lines 14, 16 to provide swinging and/or bounce to swing device 10. Spring mechanisms 18, 20 displace the topmost portions of lines 14, 16, and spring mechanisms 18, 20 are directly removeably attached to a support beam 22. Various configurations of support beams can be used, such as a piece of wood or a sufficiently weight bearing horizontal tree limb on a tree.

Figure 2:
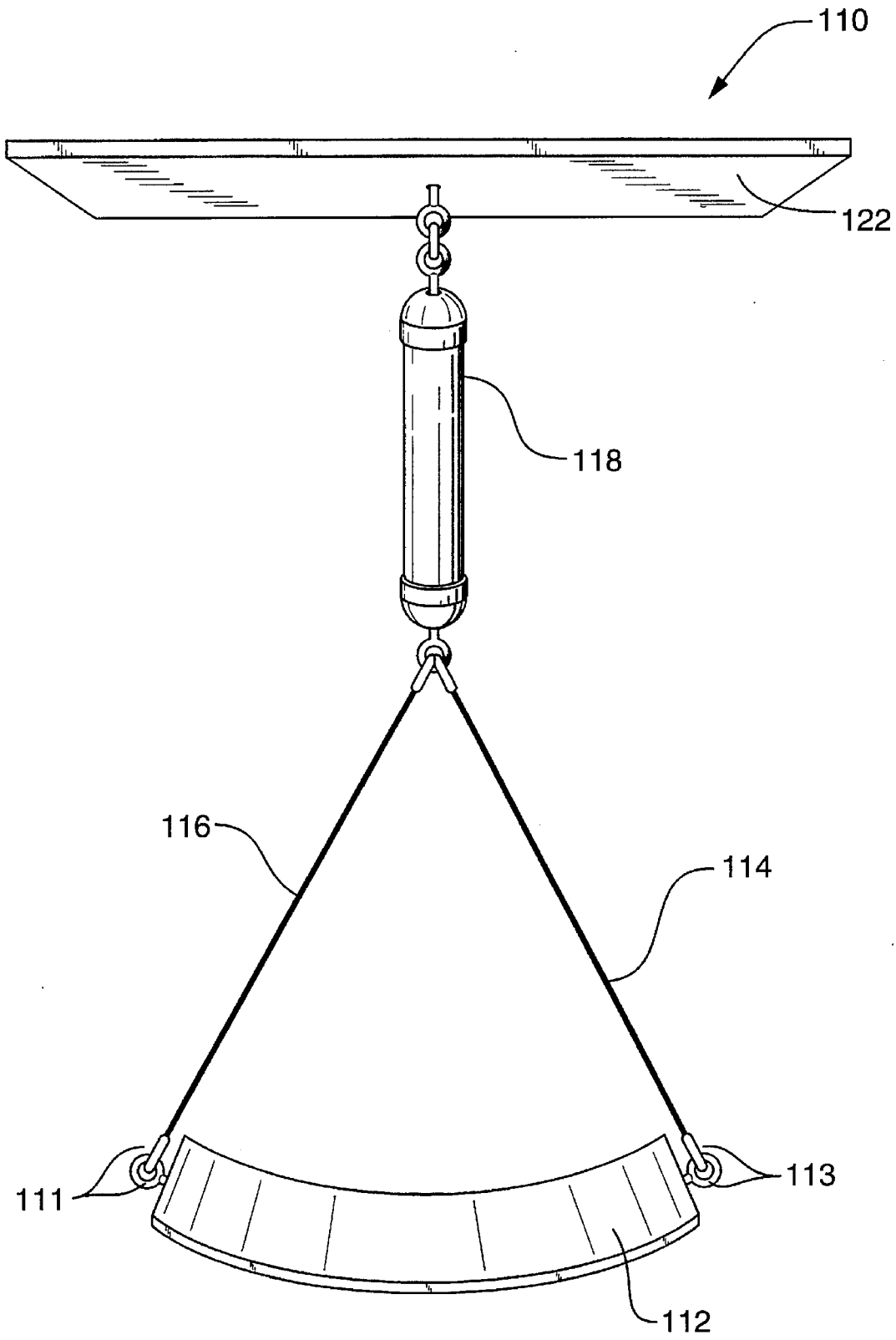
FIG. 2 is a plan view of an alternative embodiment of the spring-actuated swing device according to the invention.

Referring to FIG. 2, another embodiment of the invention is shown, generally referred to as spring-actuated swing device 110. A seat 112 is attached to lines 114, 116 via attachment structures 111, 113. As with FIG. 1, seats of various configurations can be used. Lines 114, 116 are removeably attached to the bottom end of spring mechanism 118. Spring mechanism 118 is is directly removeably attached to a support beam 122.

Figure 3:
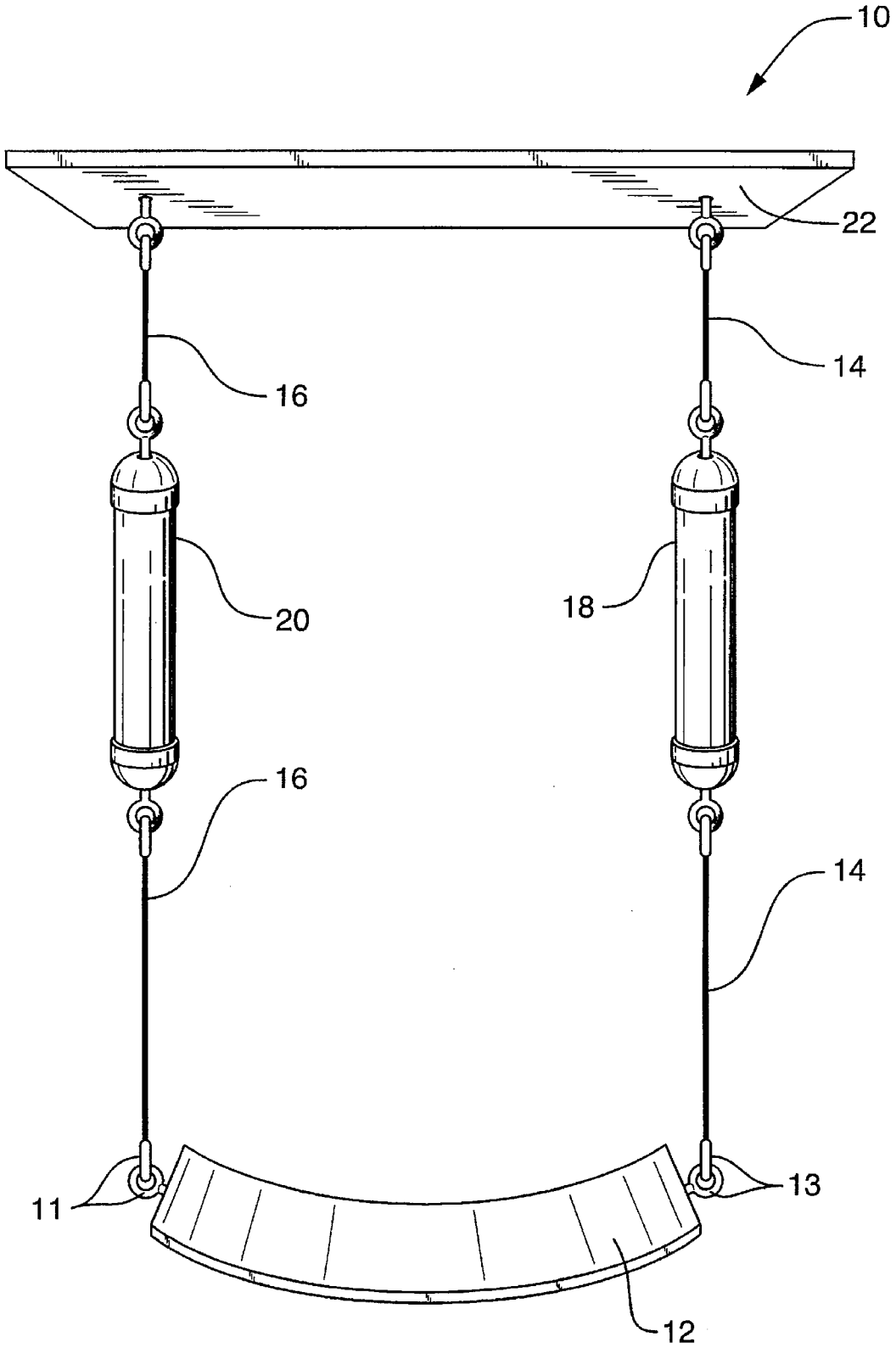
FIG. 3 is a plan view of an alternative embodiment of the spring-actuated swing device according to the invention.
Figure 4:
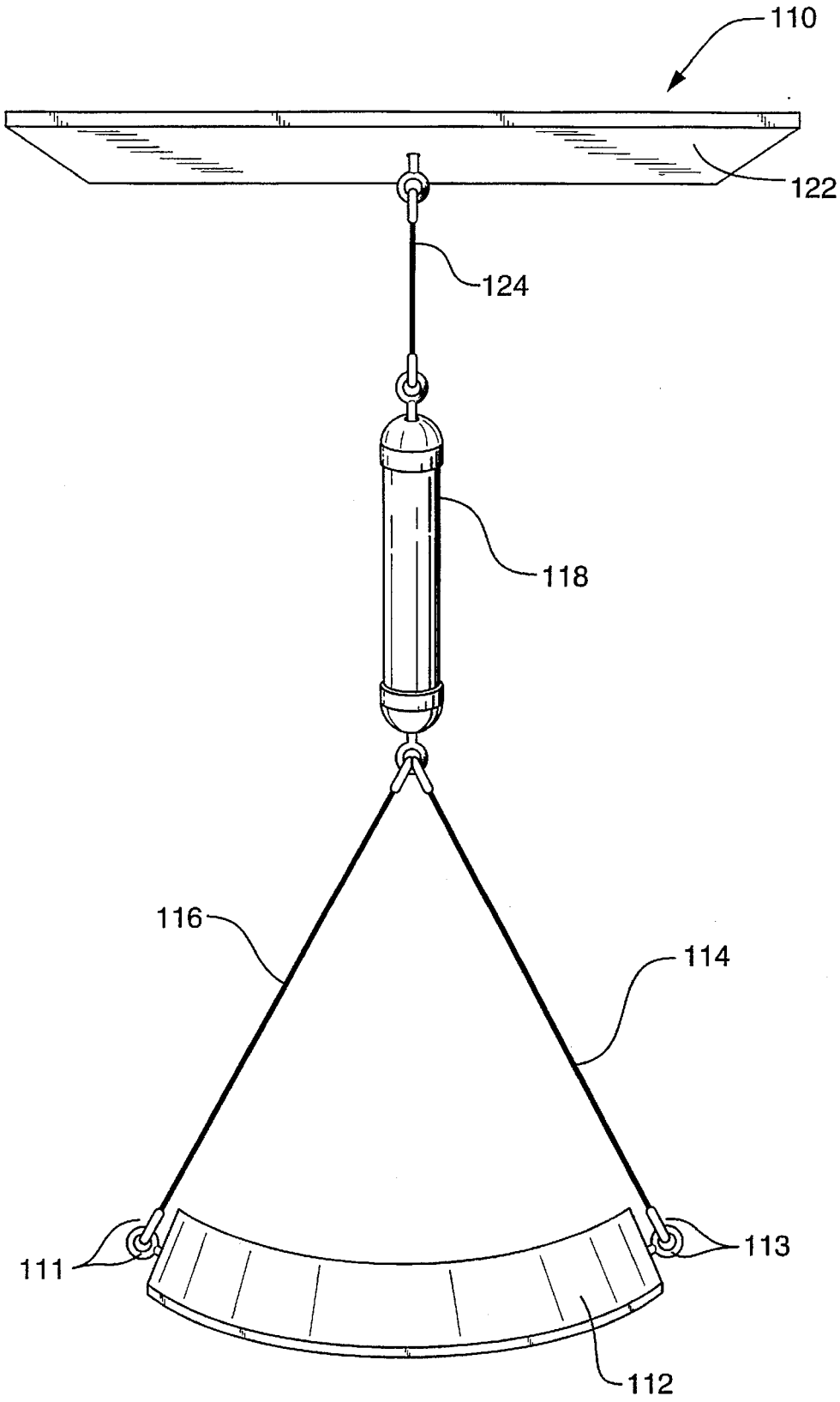
FIG. 4 is a plan view of an alternative embodiment of the spring-actuated swing device according to the invention.

Referring to FIG. 3, an alternate embodiment of a spring-actuated swing device 10 is shown. Lines 14, 16 are removeably attached at their top ends to a support beam 22. Spring mechanisms 18, 20 can be placed at nearly any intermediate point of lines 14, 16, thereby displacing portions thereof. Similarly, referring to FIG. 4, spring mechanism 118 is removably attached at its top end to a line 124, and line 124 is removeably attached to a support beam 122.

Figure 9:
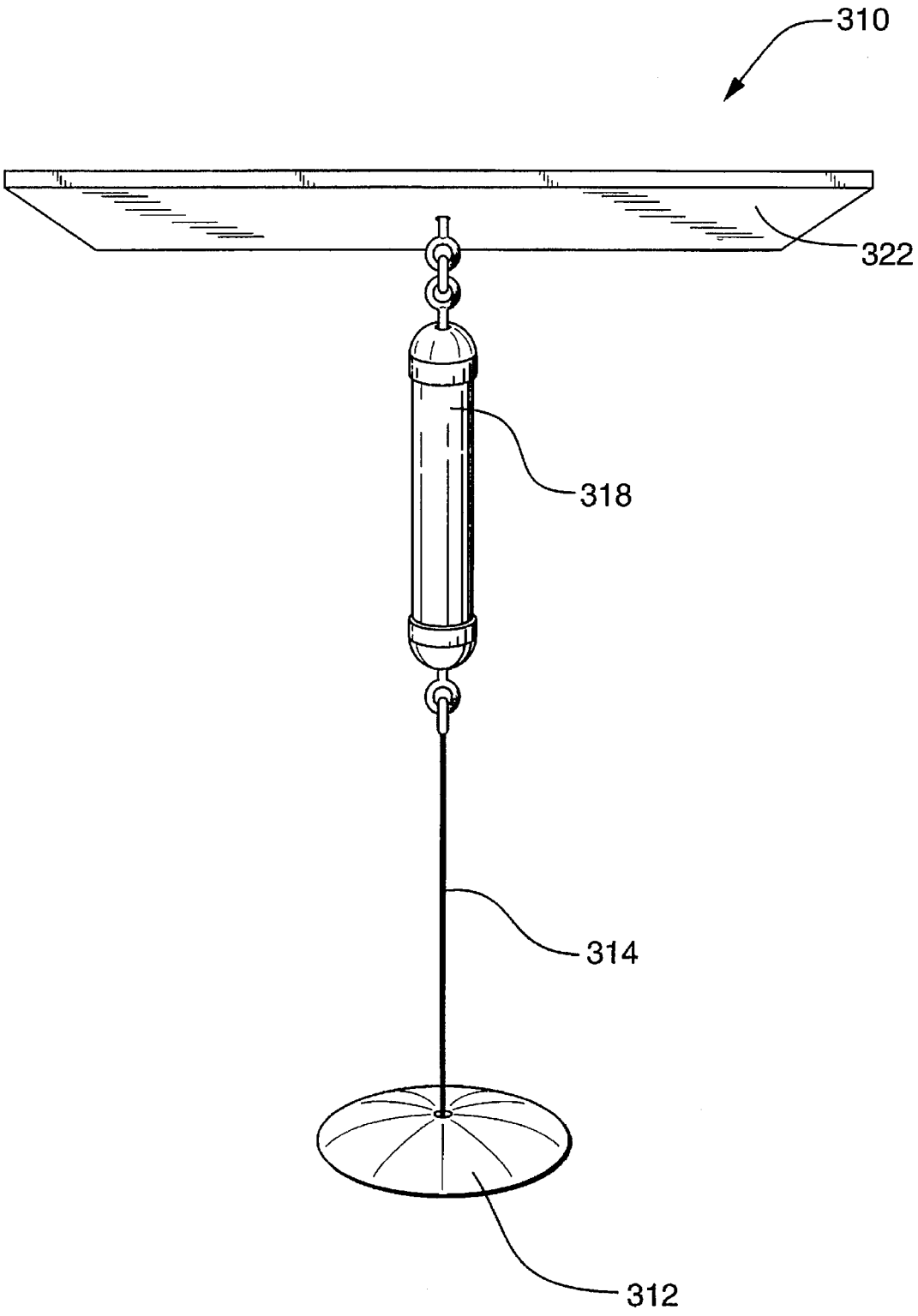
FIG. 9 is a plan view of an alternative embodiment of the spring-actuated swing device according to the invention.

Referring to FIG. 9, a single line embodiment of the invention is shown. A rigid seat 312 is removeably attached to line 314. Line 314 is removeably attached to spring mechanism 318. Spring mechanism 318 is directly removeably attached to a support beam 322. Spring mechanism may also be placed at an intermediate point of line 314, thereby displacing a portion thereof, so that the upper portion of line 314 is removeably attached to support beam 322 (not shown.)

Figure 5A:
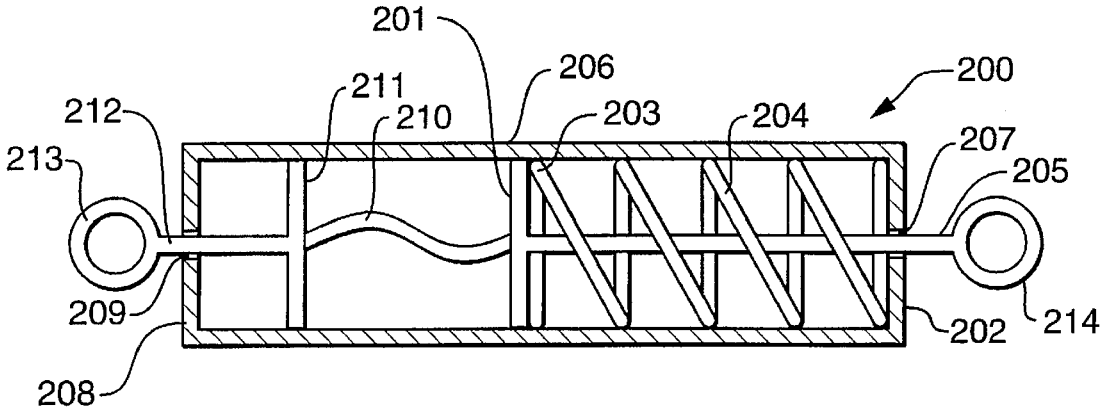
FIG. 5A is a side view of a preferred embodiment of the spring mechanism according to the invention.
Figure 5B:
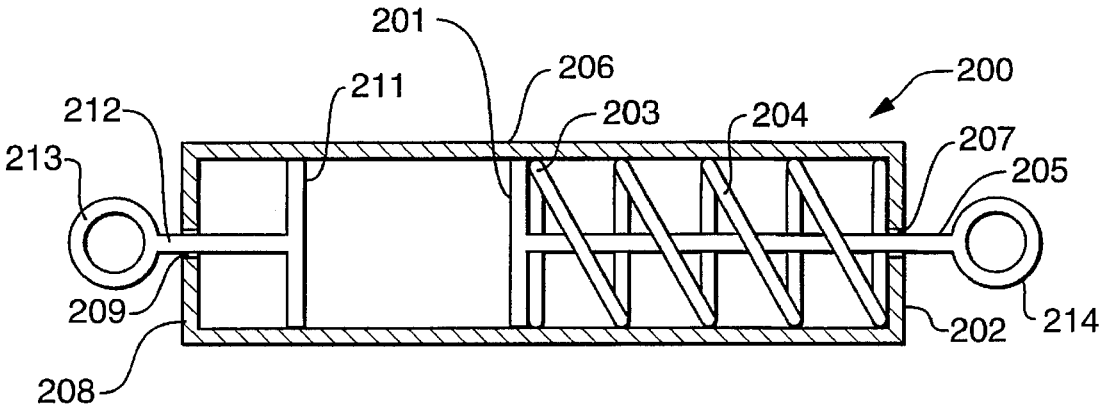
FIG. 5B is a side view of an alternative embodiment of the spring mechanism according to the invention.

Referring to FIG. 5A, a spring mechanism 200 of the invention is shown. Spring mechanism 200 has a top end 202 and a bottom end 208. Spring mechanism 200 includes an elongated member 205 which has a plate 201 attached at its lower end. Elongated member 205 can be a rigid material, such as steel, or can be a rope, chain or cable. Spring mechanism 200 includes a compression spring 204 affixed at its lower end 203 to plate 201. Housing 206 encloses spring mechanism 200. Housing 206 has an aperture 207 at its top end 202 and an aperture 209 at its bottom end 208. Elongated member 205 extends through aperture 207 for connection to a line or support beam in a piece of playground, athletic or recreational equipment (not shown.) Spring mechanism 200 can also include an emergency strap 210. Emergency strap 210 is attached to a plate 211 at one end, and elongated member 205, at the other end. In the event elongated member 205 breaks or fails, emergency strap 210 prevents spring mechanism 200 from releasing from elongated member 205, which would otherwise be free to slip through aperture 209, thus to prevent or minimize possible injury to users of the invention. A member 212 is affixed to plate 211 and member 212 extends through aperture 209. Member 212 extends through, and abuts the edges of, aperture 209, so that there is no relative movement of member 212 to aperture 209. Member 212 attaches to a line in a piece of playground, athletic or recreational equipment (not shown.) FIG. 5B shows a compression spring embodiment of the spring mechanism of the invention without an emergency strap.

In operation, a line on a piece of athletic equipment is partially displaced by spring mechanism 200. At one point the line is removeably attached to attachment structure 213, and at another point the line is removeably attached to attachment structure 214. Attachment structure 214 may be directly attached to a support beam. As the piece of equipment is used, spring 204 is compressed and the line moves and provides swinging and/or bounce to the piece of equipment. In this type of compression spring embodiment, the load is carried in housing 246.

Figure 6A:
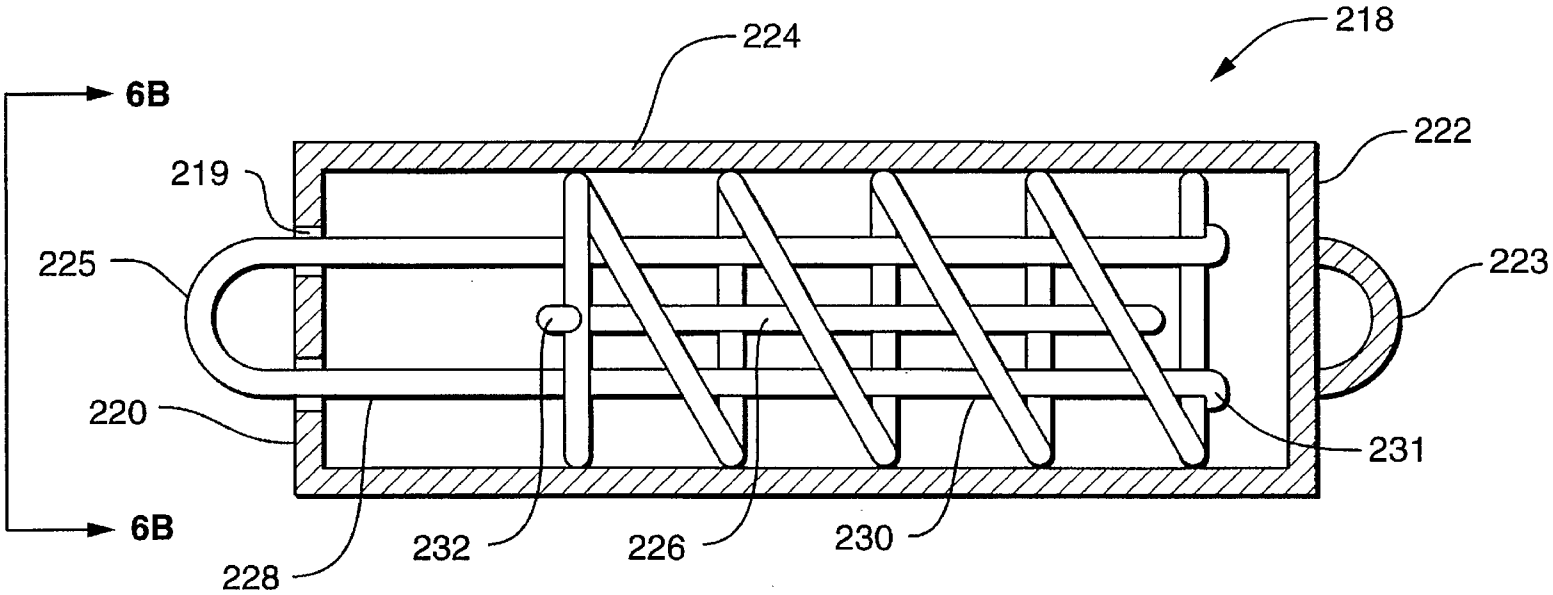
FIG. 6A is a side view of an alternative embodiment of the spring mechanism according to the invention.
Figure 7A:
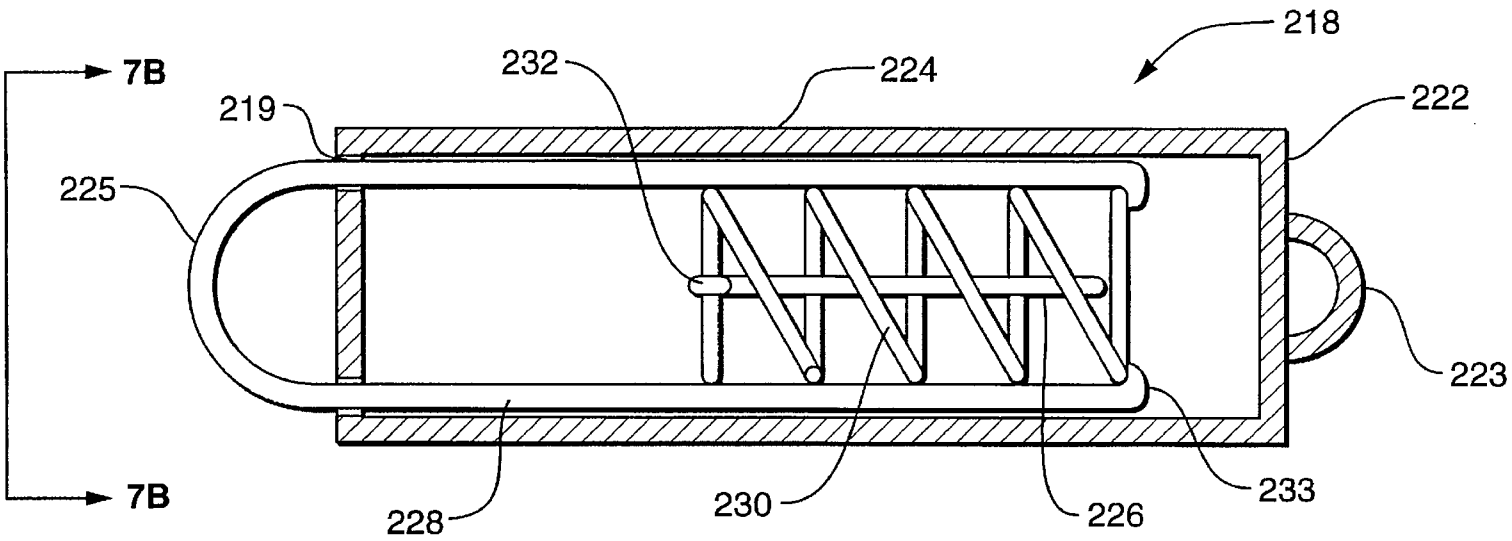
FIG. 7A is a side view of an alternative embodiment of the spring mechanism according to the invention.

Referring to FIGS. 6A and 7A, an alternate embodiment of the spring mechanism of the invention 218 is shown. Stirrup spring mechanism 218 has a top end 220 and a bottom end 222. Spring mechanism 218 includes a housing 224 which has apertures 219 at its top end. A looped member 226 is affixed to the inside of housing 224. An elongated looped member 228, made of a rigid material, such as steel, loops through apertures 219, forming loop 225, and extends inside housing 224. Looped members 226, 228 should be engineered for a weight significantly greater than the weight expected for use with the piece of equipment, to avoid any danger of loop 225 failing. A spring 230 is affixed to lower ends 221 of elongated looped member 228. Spring 230 can be inside of elongated looped member 228 (FIG. 6A). Loops 231 loop outwardly around the lower coil or coils of spring 230. Loops 232 loop outwardly around the upper coil or coils of spring 230. It is desirable for spring 230 to be inside elongated looped member 228, as shown in FIG. 6A, so that friction between spring 230 and the inside of housing 224 is eliminated. Referring to FIG. 7A, elongated looped member 228 can be inside of spring 230. Loops 233 loop inwardly around the lower coil or coils of spring 230.

Figure 6B:
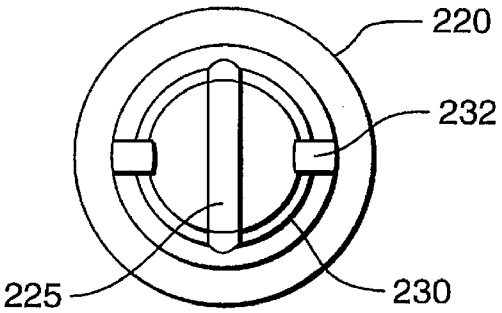
FIG. 6B is a top view of an alternate embodiment of the spring mechanism according to the invention taken along line 6B of FIG. 6A.
Figure 7B:
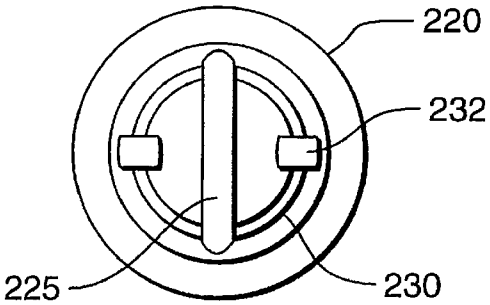
FIG. 7B is a top view of an alternate embodiment of the spring mechanism according to the invention taken along line 7B of FIG. 7A.

FIGS. 6B and 7B show top views of the stirrup spring embodiment, taken along lines 6B of FIG. 6A and 7B of FIG. 7A, respectively.

In operation, a line on a piece of playground, athletic or recreational equipment is partially displaced by spring mechanism 218. At one point the line is removeably attached to loop 225 and at another point to attachment structure 223. Loop 225 may be attached directly to a support beam. As the piece of equipment is used, spring 230 is compressed and the line moves and provides bounce to the piece of equipment. In a stirrup spring embodiment, the load is carried by looped members 226, 228 and spring 230.

Figure 8:
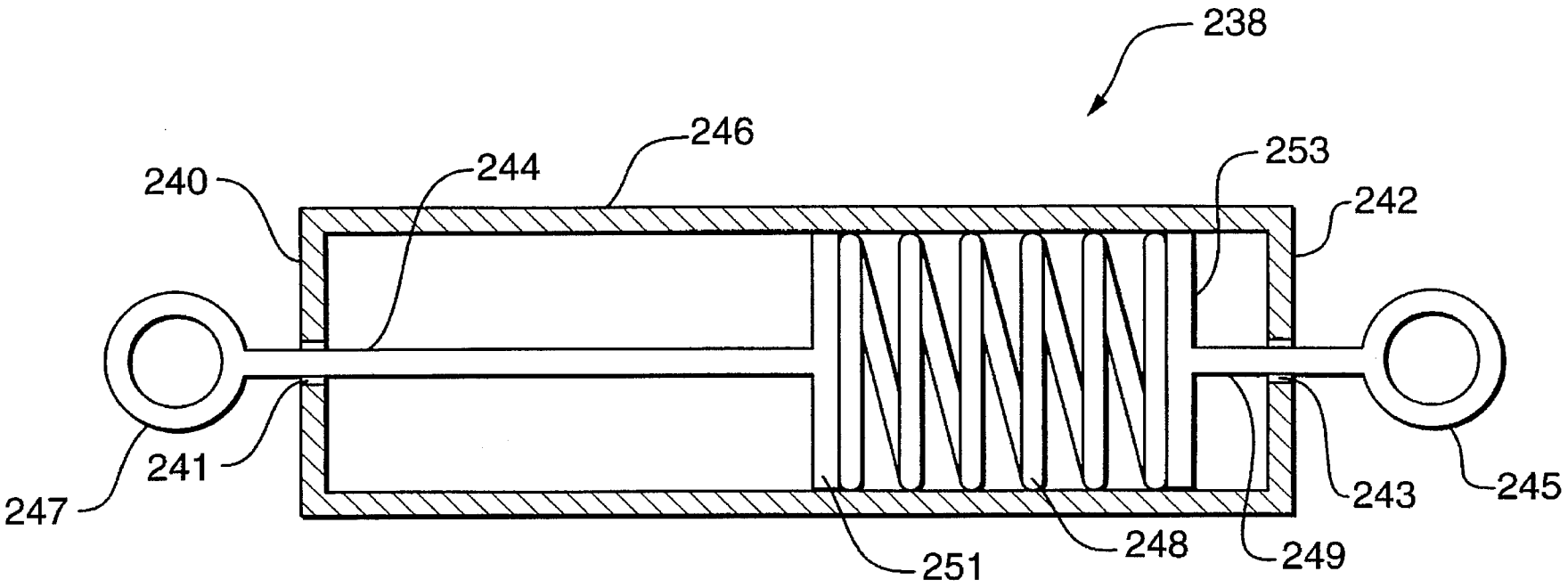
FIG. 8 is a side view of an alternative embodiment of the spring mechanism according to the invention.

Referring to FIG. 8, an alternate embodiment of the spring mechanism of the invention 238 is shown. Spring mechanism 238 has a top end 240, a bottom end 242 and a housing 246. Housing 246 has an aperture 241 at top end 240 and an aperture 243 at bottom end 242. An elongated member 244 is affixed to a plate 251, and plate 251 is affixed to extension spring 248 at the top end of extension spring 248. Elongated member 244 can be made of a rigid material, such as steel, or it can be a rope, chain or cable. A bottom end of extension spring 248 is affixed to plate 253, and plate 253 is affixed to member 249. Member 249 extends through, and abuts the edges of, aperture 243, so that there is no relative movement of member 249 to aperture 243. Elongated member 244, spring 248, member 249, plates 251, 253 and attachment structures 245, 247 may be all one piece of material. Spring mechanism 238 can also be manufactured with an emergency strap which functions similarly to the emergency strap 210 discussed with reference to FIG. 5A in order to prevent or minimize the risk of injury to users.

In operation, a line on a piece of playground, athletic or recreational equipment is partially displaced by spring mechanism 238. At one point the line is removeably attached to an attachment structure 247, and at another point to attachment structure 245. Attachment structure 247 may be attached directly to a support beam. As the piece of equipment is used, spring 248 is extended and the line moves and provides swinging and/or bounce to the piece of equipment.

A method for using a piece of equipment is also provided. A swing device such as those shown in FIGS. 1 through 4, or another piece of equipment which requires swinging and/or bounce, is provided. A user is placed in, for instance, the seat shown in FIGS. 1 through 4, and force is applied to the piece of equipment, either by someone pushing on the user or by the user pumping his legs. Due to the spring mechanism, the piece of equipment continues to swing and/or bounce for an extended period of time without requiring the application of repeated force. Therefore, the device and method of the invention are especially adapted for handicapped or small users, who do not have the ability to apply repeated force to create continued bouncing and/or swinging. A handicapped user can be placed on or in the seat of the swing, can be pushed once, and will swing and/or bounce for an extended period of time.

From the foregoing description those skilled in the art will appreciate that all of the objects of the present invention are realized. A spring-actuated swing device has been shown and described which allows for swinging and/or bouncing for an extended period of time without the need for repeated application of force.

While specific embodiments have been shown and described, many variations are possible. The device can be manufactured in different sizes and spring tensions to accomodate different weight groups. More than two lines can be used in a swing device. The seat can take on many shapes and configurations. The seat and lines can be attached in many different ways. The spring mechanism can be used on various types of playground, athletic pr recreational equipment, and can be attached at various points in equipment lines to achieve the desired effects. The housing can be made of many materials and many shapes. The spring mechanism can be manufactured in a swing or other device, or it can be retro fitted onto existing equipment.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of the invention be determined by the appended claims and their equivalents.

What is claimed is:

1. A spring-actuated swing device, comprising:

a seat including a receiving surface;

at least one line having a bottom connecting point which attaches to said receiving surface, said at least one line removeably attached directly to said receiving surface and fully supporting said seat, and said at least one line having a top connecting point removeably attached to a support beam; and at least one spring mechanism removeably attached to at least one intermediate connecting point of said at least one line intermediate said receiving surface and said support beam, said at least one spring mechanism displacing a portion of said at least one line, said at least one spring mechanism being sufficiently elastic to produce prolonged swinging.

2. The spring-actuated swing device of claim 1, wherein said spring mechanism comprises:

a compression spring;

an elongated member affixed to a lower end of said compression spring; and a housing enclosing said compression spring and having at least one aperture at a top end thereof through which said elongated member extends.

3. The spring-actuated swing device of claim 2, wherein said spring extends through said elongated member.

4. The spring-actuated swing device of claim 2, wherein said elongated member extends through said spring.

5. The spring-actuated swing device of claim 2, wherein said elongated member is selected from the group consisting of a rigid member, a rope, a chain and a cable.

6. The spring-actuated swing device of claim 1, wherein said spring mechanism comprises:

an extension spring;

an elongated member affixed to an upper end of said extension spring; and a housing enclosing said extension spring and having at least one aperture through which said elongated member extends.

7. The spring-actuated swing device of claim 6, wherein said elongated member is selected from the group consisting of a rigid member, a rope, a chain and a cable.

8. The spring-actuated swing device of claim 2, wherein said housing is made of a material selected from the group consisting of plastic, fiberglass, metal or wood.

9. The spring-actuated swing device of claim 1, wherein said device comprises two lines.

10. The spring-actuated swing device of claim 1, wherein said spring mechanism displaces the topmost portion of said at least one line and said spring mechanism is removeably attached to said support beam.

11. A spring-actuated swing device, comprising:

a seat including a receiving surface;

at least one line having a bottom connecting point, said at least one line removeably attached to said receiving surface and said at least one line having a top connecting point removeably attached to a support beam; and at least one spring mechanism, said at least one spring mechanism removeably attached to at least one intermediate connecting point of said at least one line intermediate said receiving surface and said support beam, said at least one spring mechanism displacing a portion of said at least one line, said spring mechanism comprising:

a compression spring;

an elongated member affixed to a lower end of said compression spring;

a housing enclosing said compression spring and having at least one aperture at a top end thereof through which said elongated member extends; and an emergency strap attached to said elongated member.

12. A spring-actuated swing device, comprising:

a seat including a receiving surface;

at least one line having a bottom connecting point, said at least one line removeably attached to said receiving surface and said at least one line having a top connecting point removeably attached to a support beam; and at least one spring mechanism, said at least one spring mechanism removeably attached to at least one intermediate connecting point of said at least one line intermediate said receiving surface and said support beam, said at least one spring mechanism displacing a portion of said at least one line, said spring mechanism comprising:

an extension spring;

an elongated member affixed to an upper end of said extension spring;

a housing enclosing said extension spring and having at least one aperture through which said elongated member extends; and an emergency strap attached to said elongated member.

13. A spring mechanism for producing swinging and/or bounce in playground, athletic or recreational equipment, wherein said spring mechanism comprises:

a top end;

a bottom end;

a first plate;

an elongated member having a lower end attached to said first plate and having an upper end comprising a first means for connecting said elongated member to said playground, athletic or recreational equipment;

a second member having an upper end attached to a second plate and having a lower end comprising a second means for connecting said second member to said playground athletic or recreational equipment;

a compression spring having a lower end attached to said first plate; and a housing enclosing said plates, said elongated member, said second member and said compression spring, said housing having an aperture at a top end thereof through which said elongated member extends and an aperture at a bottom end thereof through which said second member extends, whereby said apertures in said housing allow for the non-pressurized and non-adjustable passage of air into and out of said housing, thereby making said spring mechanism non-pneumatic.

14. The spring mechanism of claim 13, wherein said spring extends through said elongated member.

15. The spring mechanism of claim 13, wherein said elongated member extends through said spring.

16. The spring mechanism of claim 13, wherein said elongated member is selected from the group consisting of a rigid member, a rope, a chain and a cable.

17. A spring mechanism for producing swinging and/or bounce in playground, athletic or recreational equipment, wherein said spring mechanism comprises:

a compression spring;

an elongated member affixed to a lower end of said compression spring;

a housing enclosing said compression spring and having at least one aperture at a top end thereof through which said elongated member extends; and an emergency strap attached to said elongated member.

18. A spring mechanism for producing swinging and/or bounce in playground, athletic or recreational equipment, wherein said spring mechanism comprises:

a top end;

a bottom end;

a first plate;

an elongated member having a lower end affixed to said first plate;

an extension spring having a top end affixed to said first plate and a bottom end affixed to a second plate;

a second member affixed to said second plate on the opposite side of said second plate to which said extension spring is affixed; and a housing enclosing said first and second plates, said elongated member, said second member and said extension spring and having at least one aperture through which said elongated member extends;

whereby said at least one aperture in said housing allows for the non-pressurized and non-adjustable passage of air into and out of said housing, thereby making said spring mechanism non-pneumatic.

19. The spring mechanism of claim 18, wherein said elongated member is selected from the group consisting of a rigid member, a rope, a chain and a cable.

20. A spring mechanism for producing swinging and/or bounce in playground, athletic or recreational equipment, wherein said spring mechanism comprises:

an extension spring;

an elongated member affixed to an upper end of said extension spring;

a housing enclosing said extension spring and having at least one aperture through which said elongated member extends; and an emergency strap attached to said elongated member.

21. A method for producing swinging and/or bounce in playground, athletic or recreational equipment, comprising:

providing a seat including a receiving surface;

providing at least one line having a bottom connecting point which attaches to said receiving surface, said at least one line removeably attached directly to said receiving surface and fully supporting said seat, and said at least one line having a top connecting point removeably attached to a support beam;

providing at least one spring mechanism removeably attached to at least one intermediate connecting point of said at least one line intermediate said receiving surface and said support beam, said at least one spring mechanism displacing a portion of said at least one line;

placing an object or person in said seat; and applying force to said piece of equipment, wherein said piece of equipment continues to swing and/or bounce for an extended period of time without repeatedly applying force.

* * * * *